US010344683B2

(12) United States Patent
Hoglund et al.

(10) Patent No.: US 10,344,683 B2
(45) Date of Patent: Jul. 9, 2019

(54) COMBUSTION ENGINE AS WELL AS METHOD FOR ENGINE BRAKING USING SUCH A COMBUSTION ENGINE

(71) Applicant: FREEVALVE AB, Angelholm (SE)

(72) Inventors: Anders Hoglund, Munka Ljungby (SE); Urban Carlson, Helsingborg (SE)

(73) Assignee: FREEVALVE AB, Angelholm (SE)

( * ) Notice: Subject to any disclaimer, the term of this patent is extended or adjusted under 35 U.S.C. 154(b) by 0 days.

(21) Appl. No.: 15/518,304

(22) PCT Filed: Oct. 12, 2015

(86) PCT No.: PCT/SE2015/051083

§ 371 (c)(1),
(2) Date: Apr. 11, 2017

(87) PCT Pub. No.: WO2016/060605

PCT Pub. Date: Apr. 21, 2016

(65) Prior Publication Data

US 2017/0306860 A1 Oct. 26, 2017

(30) Foreign Application Priority Data

Oct. 15, 2014 (SE) ..... 1451234

(51) Int. Cl.
*F02D 13/04* (2006.01)
*F02B 21/00* (2006.01)
(Continued)

(52) U.S. Cl.
CPC ..... *F02D 13/04* (2013.01); *F01L 9/02* (2013.01); *F01L 13/06* (2013.01); *F02B 21/00* (2013.01);
(Continued)

(58) Field of Classification Search
CPC ..... F02D 13/04; F02D 13/06; F02D 13/028; F02D 13/0203; F01L 9/02; F01L 13/06;
(Continued)

(56) References Cited

U.S. PATENT DOCUMENTS 5,404,852 A * 4/1995 Frankle ..... F01L 13/06 123/321
5,636,611 A * 6/1997 Frankle ..... F01L 9/02 123/322
(Continued)

FOREIGN PATENT DOCUMENTS

DE 1 014 4471 A1 3/2002
EP 0 791 729 A1 8/1997
(Continued)

OTHER PUBLICATIONS

Fuchs, N., Meistrick, Z., Ernest, S., Roberts, G. et al., "Development of a High Performance Two-Cycle Engine Brake for Medium and Heavy Duty Diesel Engines," SAE Int. J. Commer. Veh. 6(1):34-46, 2013, https://doi.org/10.4271/2013-1-0586., Abstract.*
(Continued)

*Primary Examiner* — Patrick D Maines
*Assistant Examiner* — Edward Bushard
(74) *Attorney, Agent, or Firm* — Young & Thompson

(57) ABSTRACT

Disclosed is a combustion engine and method for engine braking therein including an intake air channel having a first pressure, a first inlet valve between the intake air channel and the cylinder volume, an exhaust air channel having a second pressure, a first outlet valve between the cylinder volume and the exhaust air channel, and a storage reservoir having a third pressure higher than the first and second pressures, the storage reservoir being arranged in controllable fluid communication with the cylinder volume. The method takes place during two-stroke cycle and includes:
(Continued)

displacing the piston from upper dead center (UDC) towards lower dead center (LDC), keeping the first inlet valve open during at least part of the travel from UDC to LDC, displacing the piston from LDC towards UDC, and keeping the fluid communication between the storage reservoir and cylinder volume open during at least a part of such travel.

20 Claims, 7 Drawing Sheets

(51) Int. Cl.

| | |
|---|---|
| ***F01L 13/06*** | (2006.01) |
| ***F01L 9/02*** | (2006.01) |
| ***F02B 37/22*** | (2006.01) |
| ***F02B 75/02*** | (2006.01) |
| ***F02D 13/02*** | (2006.01) |
| *F02B 37/00* | (2006.01) |

(52) U.S. Cl.
CPC ..... *F02B 37/22* (2013.01); *F02B 75/02* (2013.01); *F02D 13/0203* (2013.01); *F02D 13/028* (2013.01); *F02B 37/00* (2013.01); *F02B 2075/025* (2013.01); *F02D 13/0253* (2013.01); *F02D 13/0257* (2013.01); *F02D 13/0276* (2013.01)

(58) Field of Classification Search
CPC ..... F02B 37/00; F02B 21/00; F02B 33/14; F02B 37/20; F02B 37/10; F02B 37/22; F02B 75/02; F02B 2075/025; F02C 6/12
USPC ..... 123/320, 321, 325
See application file for complete search history.

(56) References Cited

U.S. PATENT DOCUMENTS

| | | | | |
|---|---|---|---|---|
| 6,223,846 | B1 | 5/2001 | Schechter | |
| 7,946,269 | B2 | 5/2011 | Gerum et al. | |
| 8,412,441 | B1 * | 4/2013 | Sturman | F02B 21/00 701/105 |
| 2009/0183699 | A1 | 7/2009 | Sturman | |
| 2009/0217898 | A1 | 9/2009 | Gokhale et al. | |
| 2012/0125298 | A1 | 5/2012 | Lemke et al. | |

FOREIGN PATENT DOCUMENTS

| | | | |
|---|---|---|---|
| EP | 2 876 275 | A1 | 5/2015 |
| FR | 2 831 609 | A1 | 5/2003 |
| FR | 2 916 242 | A1 | 11/2008 |
| FR | 2 991 718 | A3 | 12/2013 |
| GB | 2402169 | | 12/2004 |
| GB | 2481462 | A | 12/2011 |
| WO | 2006/122570 | | 11/2006 |
| WO | 2010/012921 | A1 | 2/2010 |
| WO | 2013/130661 | A1 | 9/2013 |

OTHER PUBLICATIONS

International Search Report, dated Feb. 5, 2016, from corresponding PCT application.
Partial Supplementary European Search Report for Application No. 15850606.3, dated May 22, 2018.
Supplementary European Search Report issued in Application No. 15850606.3, dated Oct. 24, 2018.

* cited by examiner

COMBUSTION ENGINE AS WELL AS METHOD FOR ENGINE BRAKING USING SUCH A COMBUSTION ENGINE

TECHNICAL FIELD OF THE INVENTION

The present invention relates in general to a combustion engine as well as a method for engine braking using such a combustion engine, typically being arranged in a so-called heavy vehicle. The combustion engines concerned are above all camshaft free piston engines, which are also known under the term "engines having free valves". The present invention relates specifically to a method for engine braking in a combustion engine comprising at least one cylinder having a cylinder volume and a piston displaceable in said cylinder, an intake air channel having a first pressure P1, a first inlet valve arranged between the intake air channel and the cylinder volume, an exhaust air channel having a second pressure P2, a first outlet valve arranged between the cylinder volume and the exhaust air channel, and a storage reservoir having a third pressure P3 that is higher than said first pressure P1 and said second pressure P2, the storage reservoir being arranged in controllable fluid communication with the cylinder volume.

BACKGROUND OF THE INVENTION AND PRIOR ART

Today there are several known ways of executing engine braking using a combustion engine, which methods are especially used for engine braking in combustion engines of heavy vehicles, such as diesel engines of buses and trucks. Engine braking is used in these types of vehicles for instance in long downhill slopes in order to avoid the risk of overheating the mechanical wheel braking devices of the vehicle which may lead to wholly or partial loss of braking effect.

One example of engine braking is realized by closing the exhaust air channel/exhaust gas channel by means of a valve, whereby the combustion engine continues to operate in four-stroke cycle, and when the outlet valves of the cylinder are opened, in order to evacuate exhaust gases during normal operation, a back pressure is generated downstream the cylinder. The back pressure is used to counteract the displacement of the piston from the lower dead centre to the upper dead centre when the outlet valves are open. However, this engine braking effect only corresponds to a part of the drive effect of the combustion engine, at the same time as this type of engine braking above all result in unwanted heating of the components of the combustion engine.

Engine braking according to conventional type entail that the combustion engine must have engine valve springs having high permanent spring force, which is not a problem in connection with conventional camshaft actuated engine valves since the high spring force is recovered on the back side of the cam, however it is devastating for an engine valve control without force recovery.

U.S. Pat. No. 7,946,269 to Gerum, disclose a combustion engine comprising a cylinder having a cylinder volume and a piston displaceable in said cylinder volume, and a storage volume that is arranged in controllable fluid communication with the cylinder volume via the inlet valves of the cylinders. The combustion engine is driven in four-stroke cycle during the engine braking and when the piston is displaced from the upper dead centre to the lower dead centre and the inlet valves are open, the fluid communication between the storage volume and the cylinder volume is opened. I.e. air having high pressure is provided during the intake stroke, whereupon engine braking takes place during the compression stroke. Thus, no engine braking takes place during the intake stroke, instead air having high pressure is provided that de facto counteract engine braking.

OBJECTS OF THE INVENTION

The present invention aims at obviating the aforementioned disadvantages and failings of previously known methods for engine braking in combustion engines and at providing an improved engine braking method. A primary object of the present invention is to provide an improved engine braking method of the initially defined type, which generates at least as high engine braking effect as the drive effect of the combustion engine during four-stroke cycle operation.

Another object of the present invention is to provide an engine braking method that prevents unwanted/harmful heating of the components of the combustion engine during engine breaking.

Yet another object of the present invention is to provide an engine braking method that allows the size of the engine valve springs of the combustion engine to be reduced, resulting in reduced energy consumption during normal operation.

SUMMARY OF THE INVENTION

According to the invention at least the primary object is attained by means of the initially defined method and combustion engine having the features defined in the independent claims. Preferred embodiments of the present invention are further defined in the dependent claims.

According to a first aspect of the present invention there is provided a method of the initially defined type, which is characterized by taking place during two-stroke cycle and comprises the steps of displacing the piston from the upper dead centre towards the lower dead centre, keeping the first inlet valve open during at least a part of the time the piston is displaced from the upper dead centre to the lower dead centre, opening the fluid communication between the storage reservoir and the cylinder volume, in connection with the piston being located at the lower dead centre and when the first inlet valve is closed, displace the piston from the lower dead centre towards the upper dead centre, and keeping the fluid communication between the storage reservoir and the cylinder volume open during at least a part of the time the piston is displaced from the lower dead centre to the upper dead centre.

According to a second aspect of the present invention there is provided a combustion engine that is configured to be driven in accordance with the above mentioned method.

Thus, the present invention is based on the understanding that by operating the combustion engine in two-stroke cycle during engine braking and in each compression stroke fill the cylinder volume with air having high pressure, an engine braking effect exceeding the drive effect of the combustion engine during four-stroke cycle operation is obtained. The present invention also entails that air having high pressure is provided into the cylinder volume at an early stage during the compression stroke of the two-stroke cycle, and thereby generating a great contribution to the engine braking effect.

According to a preferred embodiment the fluid communication between the storage reservoir and the cylinder volume are opened and closed a plurality of times during the displacement of the piston from the lower dead centre to the upper dead centre. This entail that each time the fluid communication between the storage reservoir and the cylinder volume is closed during the displacement of the piston from the lower dead centre to the upper dead centre, the pressure in the cylinder volume will increase above the existing pressure in the storage reservoir and thereby an extra contribution to the engine braking effect is obtained in relation to the case when the fluid communication between the storage reservoir and the cylinder volume is open.

According to a preferred embodiment the storage reservoir is connected to the exhaust air channel via a controllable valve, the method comprising the step of ventilating the cylinder volume by means of a short opening of the first outlet valve, in connection with the piston being located at the upper dead centre and when the fluid communication between the storage reservoir and the cylinder volume is closed. This entail that the pressure in the cylinder volume is drastically reduced at the same time as heat is released via the exhaust gas system of the vehicle.

In yet another preferred embodiment the method comprises the step of keeping the controllable valve open in order to have the storage reservoir in fluid communication with the turbine, in connection with the step of keeping the first inlet valve open during at least a part of the time the piston is displaced from the upper dead centre to the lower dead centre. This entail that it is secured that fresh air is provided into the cylinder volume by means of the compressor that is driven by the turbine, leading to cooling down of the components of the combustion engine.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
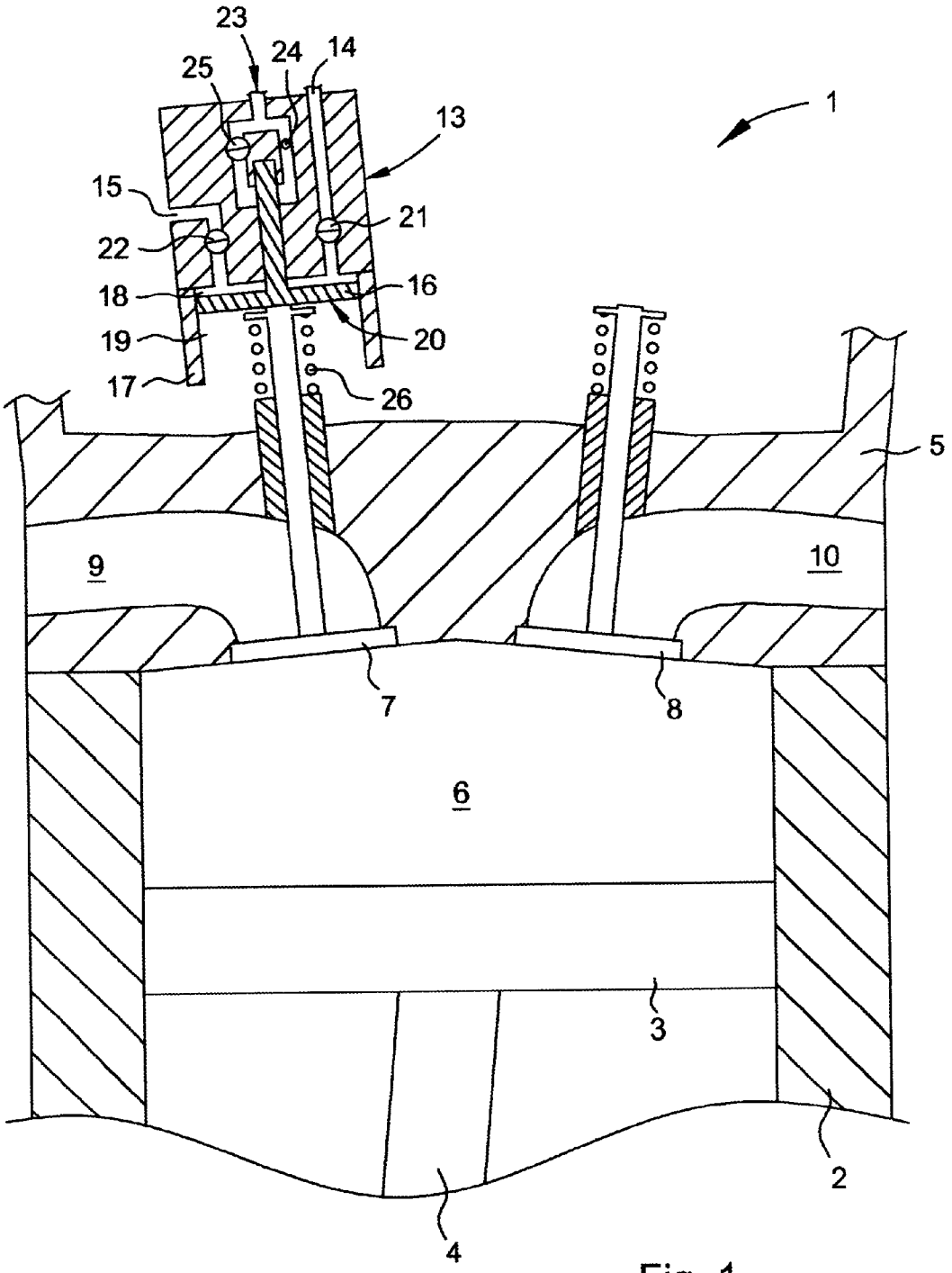
FIG. 1 is a schematic cross sectional view of a part of a combustion engine.
Figure 2:
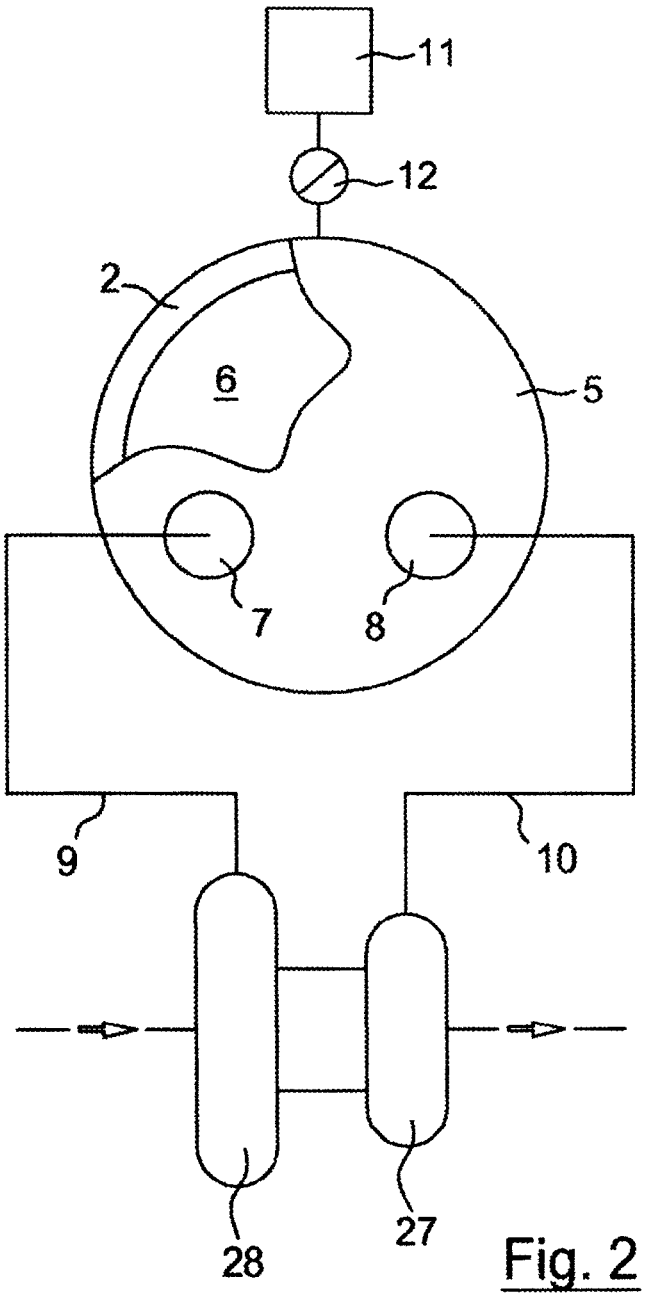
FIG. 2 is a schematic illustration of a combustion engine according to the overall inventive concept.

Reference is initially made to FIGS. 1 and 2, wherein the overall inventive concept will be described with reference thereto. The present invention relates to a combustion engine, generally designated 1, as well as to a method for engine braking in such a combustion engine 1. It shall be pointed out that energy recovery is not central, nor desirable, in applications in which the inventive combustion engine 1 and method are intended to be used, on the contrary it is instead central to maximize the energy consumption.

The combustion engine 1 comprises a cylinder block having at least one cylinder 2. Usually said cylinder block comprises three or four cylinders 2. In the disclosed embodiment one cylinder 2 is described, however it shall be realized that the equipment described herein below in connection with the disclosed cylinder 2 is preferably applied to all cylinders of the combustion engine 1, in the case the combustion engine comprises a plurality of cylinders. The combustion engine 1 is preferably a diesel engine in a vehicle, such as a bus or a truck.

Thereto the combustion engine 1 comprises a piston 3 axially displaceable in said cylinder 2. The movement of the piston 3, axial displacement back and forth, is transmitted in a conventional way to a piston rod 4 connected to the piston 3, the piston rod 4 in its turn being connected to and drives a crankshaft (not disclosed) in rotation.

The combustion engine 1 also comprises a cylinder head 5 that together with said cylinder 2 and said piston 3 delimits a cylinder volume 6, or combustion chamber. In the cylinder volume 6 ignition of a mixture of fuel and air takes place in a conventional way during normal operation of the combustion engine, and is not described more herein. During normal operation the combustion engine 1 is preferably driven in four-stroke cycle operation, but it shall be realized that also two-stroke cycle operation is possible.

The combustion engine 1 further comprises a first inlet valve 7 and a first outlet valve 8, which preferably are constituted by traditional gas exchange valves. Said first inlet valve 7 is an intake air valve that is configured to optionally open/close the supply of air to the combustion chamber 6 during normal operation. The first outlet valve 8 is an exhaust air valve, or exhaust gas valve, that is configured to optionally open/close for evacuation of exhaust gases from the combustion chamber 6 during normal operation.

The first inlet valve 7 is arranged between the cylinder volume 6 and an intake air channel 9, in which there is a first pressure P1. The first outlet valve 8 is arranged between the cylinder volume 6 and an exhaust air channel 10, in which there is a second pressure P2. Each of first pressure P1 and the second pressure P2 is preferably in the range 1-5 bar absolute.

The combustion engine 1 further comprises a storage reservoir 11, in which there is a third pressure P3. The third pressure P3 is strictly greater than each of the first pressure P1 and the second pressure P2, and is preferably in the range 15-20 bar absolute. The storage reservoir 11 is arranged for controllable fluid communication with the cylinder volume 6. In the embodiment according to FIG. 2 the storage reservoir 11 is connected to the cylinder volume 6 via a controllable storage reservoir valve 12.

Furthermore in the preferred embodiment, the combustion engine 1 comprises a valve actuator 13 that is operatively connected to said first inlet valve 7. Only the valve actuator 13 that is connected to the first inlet valve 7 will be described herein, however it shall be realized that also the first outlet valve 8, and other possible inlet valves and outlet valves, is operatively connected to such a valve actuator. The disclosed, preferred valve actuator 13 comprises at least one inlet opening 14 for pressure fluid and at least one outlet opening 15 for pressure fluid. The pressure fluid is a gas or gas mixture, preferably air or nitrogen. Air has the advantage that it is easy to exchange the pressure fluid or add more pressure fluid if the pressure fluid leak, and nitrogen has the advantage that it is free from oxygen and thereby prevents oxidation of other components. It shall be pointed out that also other types of valve actuators are conceivable.

Thereto it shall be pointed out that each valve actuator can be operatively connected to one or more gas exchange valves, for instance the combustion engine 1 may comprise two inlet valves which are jointly driven by one and the same valve actuator 13. However it is preferred that each valve actuator drive one gas exchange valve each in order to obtain best possible controllability of the operation of the combustion engine 1.

The disclosed valve actuator 13 comprises an actuator piston disc 16 and an actuator cylinder 17 delimiting a cylinder volume. The actuator piston disc 16 separate said cylinder volume in an upper part 18 and a lower part 19 and is axially displaceable in said actuator cylinder 17. The actuator piston disc 16 form part of an actuator piston or pusher, generally designated 20, that is configured to abut and drive the first inlet valve 7.

The valve actuator 13 comprises a controllable inlet valve 21 that is arranged to open/close the inlet opening 14, a controllable outlet valve 22 that is arranged to open/close the outlet opening 15, a hydraulic circuit, generally designated 23, that in its turn comprises a check valve 24 arranged to allow filling of hydraulic circuit 23 and a controllable emptying valve 25 arranged to control the emptying of the hydraulic circuit 23. It shall be pointed out that the valves disclosed in this document are schematically presented and may for instance be constituted by slide valves, seat valves, etc. Thereto several of the above mentioned controllable valves may be constituted by a single body. Each valve may be directly or indirectly electrically controlled. By electrically controlled is meant that the position of the valve is directly controlled by for instance an electro magnet device, and by indirectly electrically controlled is meant that the position of the valve is controlled by a pressure fluid that in its turn is controlled by for instance an electromagnetic device.

In order to obtain a displacement of the actuator piston disc 16 downwards, in order to open the first inlet valve 7, the inlet valve 21 is open to allow filling of pressure fluid having high pressure into the upper part 18 of the cylinder volume. When the actuator piston 20 is displaced downwards the check valve 24 of the hydraulic circuit 23 is opened, whereupon hydraulic liquid is sucked in and replace the volume that the actuator piston 20 leave. Thereafter the inlet valve 21 is closed and the pressure fluid that has entered the upper part 18 of the cylinder volume is allowed to expand whereupon the actuator piston disc 16 continues its movement downwards. When the pressure fluid in the upper part 18 of the cylinder volume does not manage to displace the actuator piston disc 16 any more, i.e. when the pressure from lower side of the actuator piston disc 26 and the return spring 26 of the first inlet valve 7 is equal to the pressure on the upper side of the actuator piston disc 16, the actuator piston disc 16 stop. The actuator piston disc 16 is kept (locked) in the lower position a required time by holding the emptying valve 25 of the hydraulic circuit 23 closed at the same time as the check valve 24 of the hydraulic circuit 23 is automatically closed. In order to accomplish a return movement the outlet valve 22 is opened in order to allow evacuation of pressure fluid from the upper part 18 of the cylinder volume, and thereto the emptying valve 25 of the hydraulic circuit 23 is opened whereupon the actuator piston disc 16 is displaced upwards when the hydraulic liquid is evacuated from the hydraulic circuit 23, and at the same time the pressure fluid is evacuated from the upper part 18 of the cylinder volume via the outlet opening 15.

Preferably, the combustion engine 1 comprises a turbine 27, connected to and arranged downstream the exhaust air channel 10, and an air compressor 28, connected to and arranged upstream the intake air channel 9, the turbine 27 being arranged to drive the air compressor 28. The air passing through the turbine 27 from the exhaust air channel 10 generates a rotation of a turbine impeller, which is connected to and configured to drive a compressor impeller in the air compressor 28. The compressor impeller such in ambient air and press the air, preferably cooled, into the intake air channel 9. The turbine 27 and the air compressor 28 are preferably part of a conventional super charger unit.

It shall be pointed out that in this document the intake air channel 9 extend to the first inlet valve 7 in the direction from the air compressor 28, and the exhaust air channel 10 extend from the first outlet valve 8 in the direction towards the turbine 27.

The inventive method and combustion engine will be described herein below according to different alternative embodiments, which all belong to the one and same inventive concept/inventive idea that will be described with reference to FIG. 2, but is also valid for all disclosed embodiments and equivalent embodiments. Thus, the described embodiments are only alternative realizations of the invention.

Figure 3:
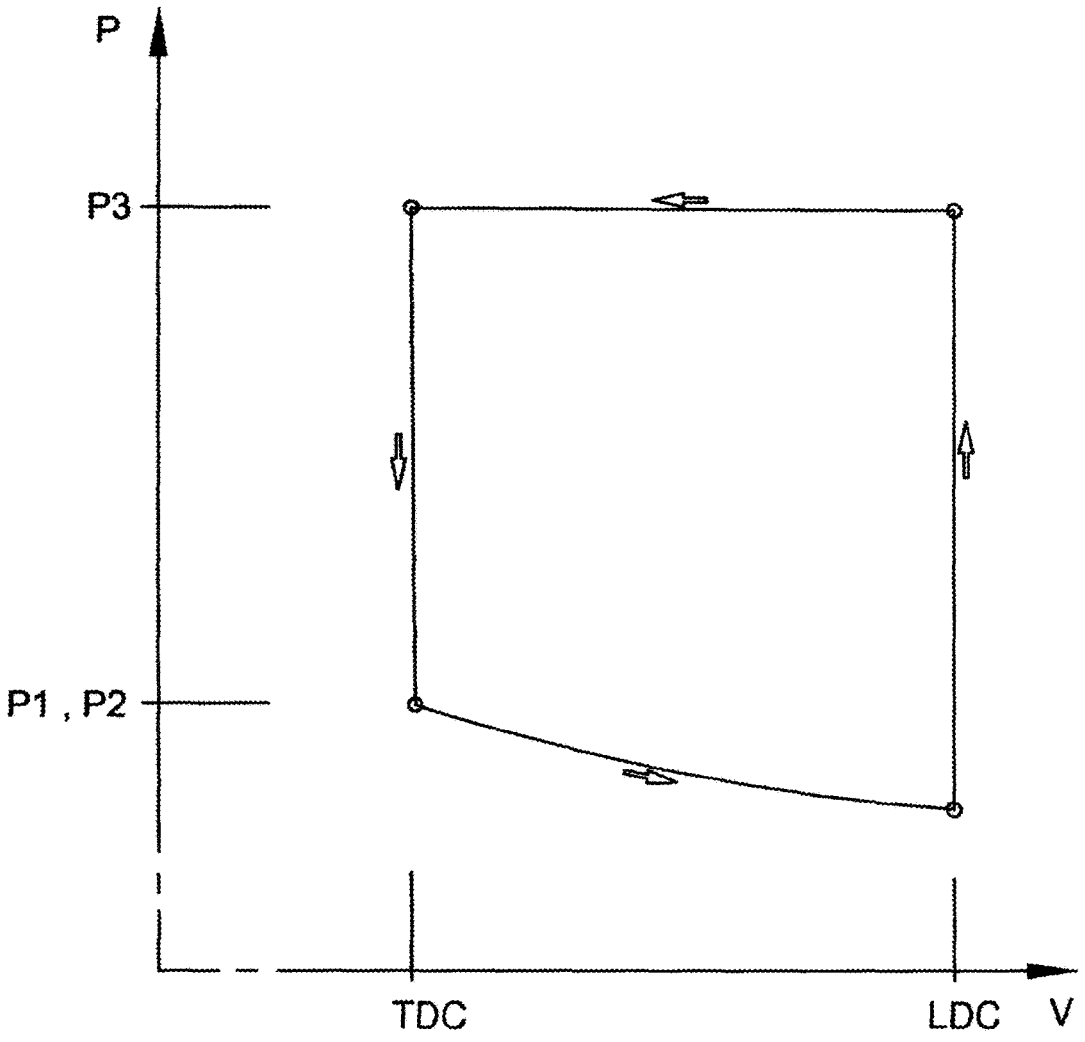
FIG. 3 is a schematic illustration of a P/V-diagram for a break cycle.

During the inventive engine braking method the combustion engine 1 is driven in two-stroke cycle, independent from the combustion engine 1 being driven in four-stroke cycle or two-stroke cycle during normal operation. In FIG. 3 is shown a schematic illustration of a braking cycle in a so-called P/V-diagram, wherein P stands for existing pressure in the cylinder volume 6 and V stands for existing volume of the cylinder volume 6 by indicating the Location of the piston 3 between the upper dead centre UDC and lower dead centre LDC.

The method comprises the steps of displacing the piston 3 from the upper dead centre UDC towards the lower dead centre LDC, keeping the first inlet valve 7 open during at least a part of the time the piston 3 is displaced from the upper dead centre to the lower dead centre, displacing the piston 3 from the lower dead centre towards the upper dead centre, and keeping the fluid communication between the storage reservoir 11 and the cylinder volume 6 open during at least a part of the time the piston 3 is displaced from the lower dead centre to the upper dead centre.

When the fluid communication between the storage reservoir 11 and the cylinder volume 6 is open, the third pressure P3 exist in the cylinder volume 6, acting braking to the piston 3 when it is displaced in the direction from the lower dead centre to the upper dead centre. When the first inlet valve 7 is open the existing pressure in the cylinder volume 6 is equal to the first pressure P1, and the cylinder volume 6 is ventilated. The fluid communication between the storage reservoir 11 and the cylinder volume 6 is controlled by means of the storage reservoir valve 12.

Preferably the method comprises the step of opening the fluid communication between the storage reservoir 11 and the cylinder volume 6, in connection with the piston 3 being located at the lower dead centre and when the first inlet valve 7 is closed. This entail that the third pressure P3 starts to act against the piston 3 as early as possible during the compression stroke.

Preferably the method comprises the step of securing that the fluid communication between the storage reservoir 11 and the cylinder volume 6 is closed, in connection with the piston 3 being located in the upper dead centre, in order not to provide the third pressure P3 from the storage reservoir 11 to the cylinder volume 6 during the piston being displaced from the upper dead centre to the lower dead centre.

According to one embodiment of the fundamental inventive concept the fluid communication between the storage reservoir 11 and the cylinder volume 6 is open during the entire displacement of the piston 3 from the lower dead centre to the upper dead centre. This result in that the third pressure P3 exists in the cylinder volume 6 during the entire compression stroke, which provide good engine braking effect (according to FIG. 3). According to an alternative embodiment the fluid communication between the storage reservoir 11 and the cylinder volume 6 is opened and closed a plurality of times during the displacement of the piston 3 from the lower dead centre to the upper dead centre. This result in that each time the fluid communication is open the third pressure P3 exists in the cylinder volume 6, which provide good engine braking effect, and each time the fluid communication is closed during the displacement of the piston in the direction from the lower dead centre to the upper dead centre the pressure in the cylinder volume 6 increase, which provide extra engine braking effect. During the displacement of the piston 3 from the lower dead centre to the upper dead centre the fluid communication between the storage reservoir 11 and the cylinder volume 6 may be kept closed, subsequent it has been open, as long as the pressure in the cylinder volume 6 does not obstruct the valves that are facing the cylinder volume 6 to be opened as intended to. The pressure in the cylinder volume 6 should not exceed a pressure of about 30 bar absolute, even thus a pressure of about 200 bar is possible from a physical properties point of view.

Preferably the method comprises the step of ventilating the cylinder volume 6 by means of short opening of the first inlet valve 8 and/or the first outlet valve 7, in connection with the piston 3 being located at the upper dead centre and when the fluid communication between the storage reservoir 11 and the cylinder volume 6 is closed (according to FIG. 3).

Figure 5:
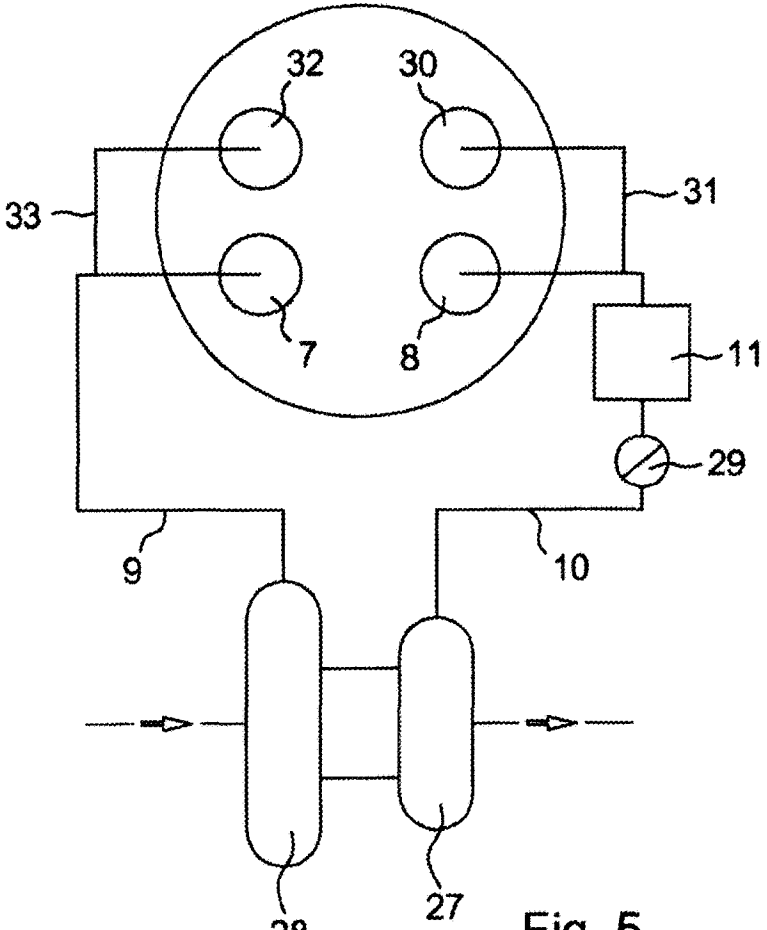
FIG. 5 is a schematic illustration of the combustion engine according to a second alternative of the first embodiment.
Figure 4:
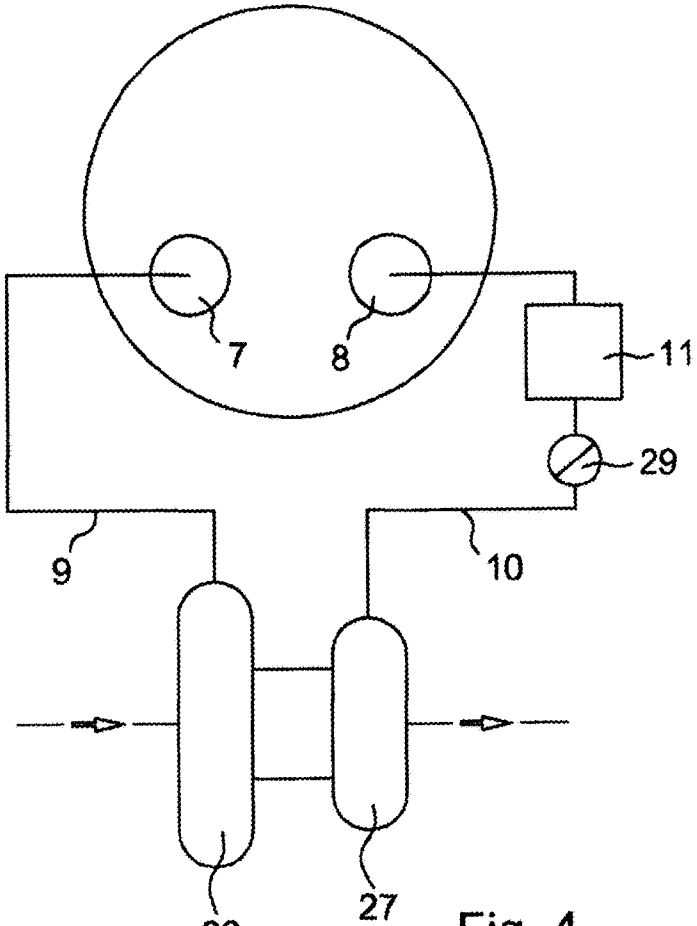
FIG. 4 is a schematic illustration of the combustion engine according to a first alternative of a first embodiment.

Reference is now also made to FIGS. 4 and 5, which disclose two alternatives of a first embodiment of the invention. First of all only additions in relation to the above will be described, everything else is the same if nothing else is stated.

According to this first embodiment of the invention the combustion engine 1 comprises a controllable valve 29 arranged in the exhaust air channel 10, the storage reservoir 11 being arranged between the first outlet valve 8 and the controllable valve 29. In other words, the fluid communication between the storage reservoir 11 and the cylinder volume 6 is controlled by means of the first outlet valve 8. The storage reservoir 11 may be constituted by a part of the actual exhaust air channel 11, or alternatively may be constituted by a separate tank arranged in, or connected to, the exhaust air channel 10.

In the second alternative of the first embodiment (FIG. 5), the combustion engine also comprises a second cutlet valve 30, that is arranged in parallel with the first outlet valve 8. A second exhaust air channel 31 extends from the second outlet valve 30 and is connected to the exhaust air channel 10 upstream the controllable valve 29. The second exhaust air channel 31 is connected to the exhaust air channel 10 directly or indirectly via the storage reservoir 11. In other words, the storage reservoir 11 is also arranged between the second outlet valve 30 and the controllable valve 29. Thereto the combustion engine comprises a second inlet valve 32, which is arranged in parallel with the first inlet valve 7. A second intake air channel 33 is connected to the intake air channel 9 and extends to the second inlet valve 32.

It shall be realized that in the description herein below the second inlet valve 32 may be controlled jointly with the first inlet valve 7, and the second outlet valve 30 may optionally be controlled jointly with the first outlet valve 8, alternatively the second inlet valve 32 and/or the second outlet valve 30 may be kept closed during the entire engine braking, if nothing else is stated.

In this first embodiment of the invention the method comprises the step of ventilating the cylinder volume 6 by means of short opening of the first inlet valve 7, in connection with the piston 3 being located at the upper dead centre and when the fluid communication between the storage reservoir 11 and the cylinder volume 6 is closed. Thereby the pressure in the cylinder volume 6 is decreased from the prevailing pressure, which is at least as high as the third pressure P3, to become equal to the first pressure P1 existing in the intake air channel 9. Thereafter the first inlet valve 7 is closed and when the piston 3 is displaced in the direction from the upper dead centre to the lower dead centre the existing pressure in the cylinder volume 6 decreases to a level below the first pressure P1 that provide a braking effect to the piston 3, and thus generates engine braking effect.

Thereto the first inlet valve 7 may be opened at least one more time during the displacement of the piston 3 in the direction from the upper dead centre to the lower dead centre, when the existing/prevailing pressure in the cylinder volume 6 is lower than the first pressure P1, in order to provide fresh air to the cylinder volume in order to cool down the cylinder 2. In connection with, i.e. jointly or just before, fresh air is provided to the cylinder volume 6 via the first inlet valve 7, the controllable valve 29 in the exhaust air channel 10 may be opened whereby the pressurized gas in the storage reservoir 11 drives the turbine 27 that drives the air compressor 28 that secure good supply of fresh air.

The point of time fresh air is supplied to the cylinder volume 6, e.g. when the first inlet valve 7 is opened, shall preferably take place during the second half of the displacement of the piston 3 in the direction from the upper dead centre to the lower dead centre, most preferably during the last quarter of the displacement of the piston 3 in the direction from the upper dead centre to the lower dead centre. The first inlet valve 7 is closed at the latest when the piston 3 is located at the lower dead centre.

Figure 7:
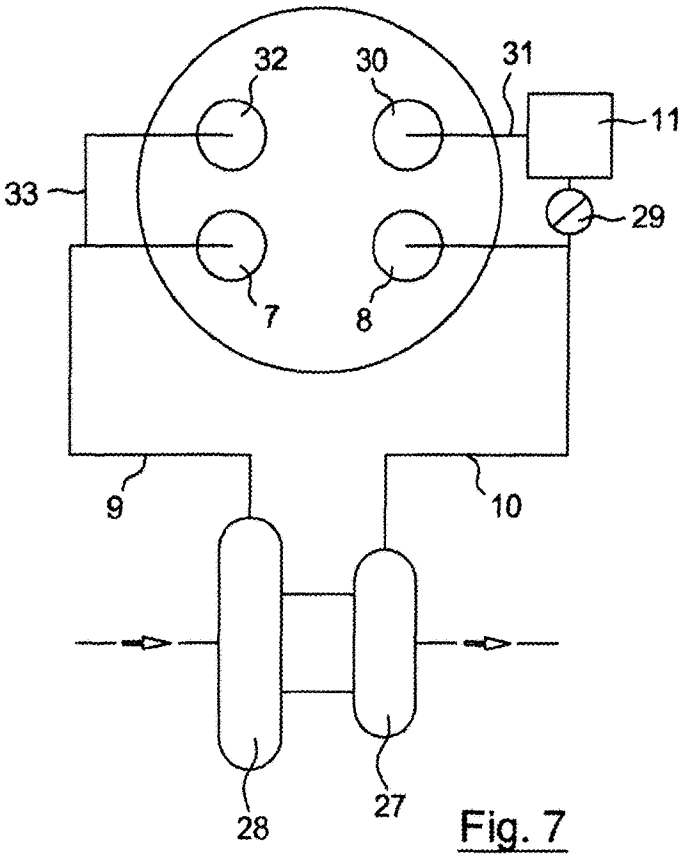
FIG. 7 is a schematic illustration of the combustion engine according to a second alternative of the second embodiment.
Figure 6:
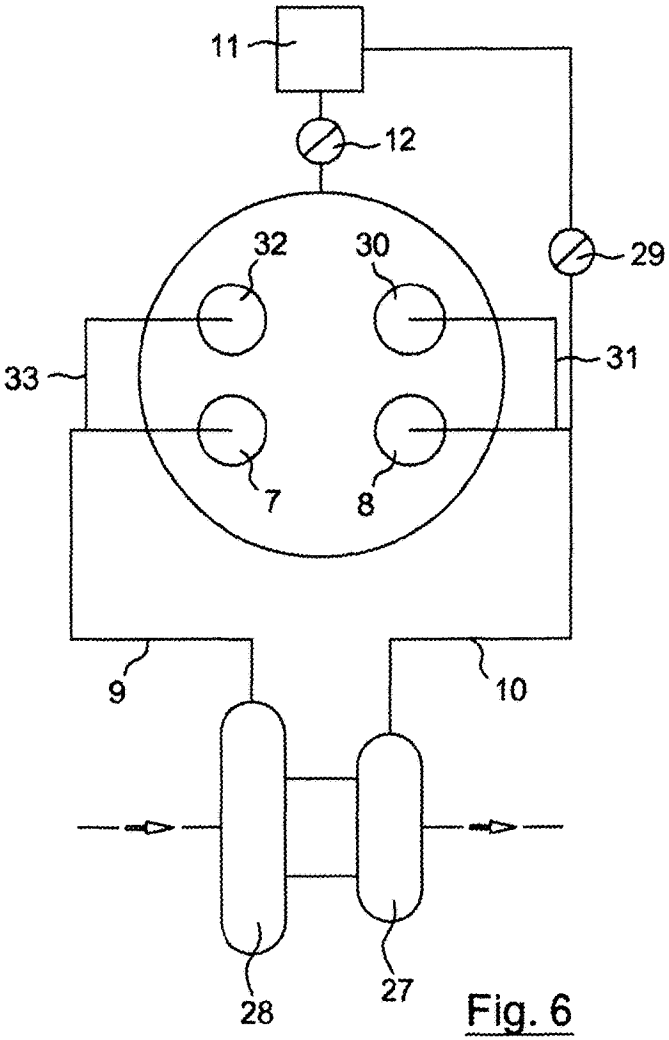
FIG. 6 is a schematic illustration of the combustion engine according to a first alternative of a second embodiment.

Reference is now made to FIGS. 6 and 7, which disclose two alternatives of a second embodiment of the invention. First of all only differences and additions in relation to the above will be described, everything else is the same if nothing else is stated. It shall be pointed out that in these embodiments the controllable valve 29 may alternatively be constituted by an over pressure valve that opens at a predetermined pressure, however it is mentioned as being the controllable valve 29 for sake of clarity.

According to this second embodiment of the invention the storage reservoir 11 is connected to the exhaust air channel 10, the controllable valve 29 of the combustion engine 1 being arranged between the storage reservoir 11 and the exhaust air channel 10. According to the first alternative of the second embodiment (FIG. 6) the fluid communication between the storage reservoir 11 and the cylinder volume 6 is controlled by means of the controllable storage reservoir valve 12.

According to the second alternative of the second embodiment (FIG. 7) the fluid communication between the storage reservoir 11 and the cylinder volume 6 is controlled by means of the second outlet valve 30, whereupon the controllable valve 29 and the storage reservoir 11 are arranged in the second exhaust air channel 31. The storage reservoir 11 may be constituted by a part of the second exhaust air channel 31, or alternatively may be constituted by a separate tank arranged in, or connected to, the second exhaust air channel 31. For sake of clarity it shall be pointed out that the second outlet valve 30 is not controlled jointly with the first outlet valve 9 during engine braking in this second alternative of the second embodiment.

In this second embodiment of the invention the method comprises the step of ventilating the cylinder volume 6 by means of short opening of the first outlet valve 8, in connection with the piston 3 being located at the upper dead centre and when the fluid communication between the storage reservoir 11 and the cylinder volume 6 is closed. Thereby the pressure in the cylinder volume 6 decreases from the prevailing pressure, which is at least as high as the third pressure P3, to a level equal to the second pressure P2 existing in the exhaust air channel 10. Thereafter the first outlet valve 8 is closed and when the piston 3 is displaced in the direction from the upper dead centre to the lower dead centre the prevailing pressure in the cylinder volume 6 decreases to a level below the second pressure P2 that provide a braking effect to the piston 3, and thus generates engine braking effect. It shall be pointed out that the ventilation of the cylinder volume 6, as a complement to or as an alternative to the short opening of the first outlet valve 8, may take place by means of short opening of the first inlet valve 7, in accordance with the first embodiment described above.

Furthermore the method may comprise the step of keeping the controllable valve 29 open whereby the storage reservoir 11 is in fluid communication with the turbine 27, in connection with the step of keeping the first inlet valve 7 open during at least a part of the time of the displacement of the piston 3 in the direction from the upper dead centre to the lower dead centre. This preferably take place when the existing pressure in the cylinder volume 6 is lower than the first pressure P1, in order to provide fresh air to the cylinder volume in order to cool down the cylinder 2. In connection with, e.g. jointly or before, fresh air is supplied to the cylinder volume 6 via the first inlet valve 7 the controllable valve 29 may be opened whereupon the pressurized gas in the storage reservoir 11 drives the turbine 27 that drives the air compressor 28 that secure good supply of fresh air.

Figure 9:
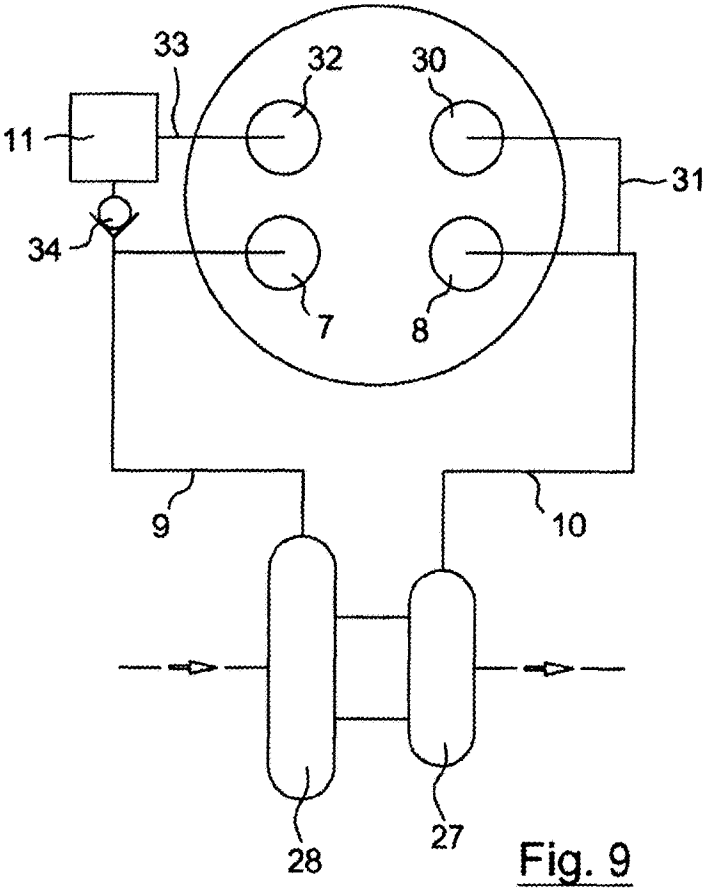
FIG. 9 is a schematic illustration of the combustion engine according to a second alternative of the third embodiment.
Figure 8:
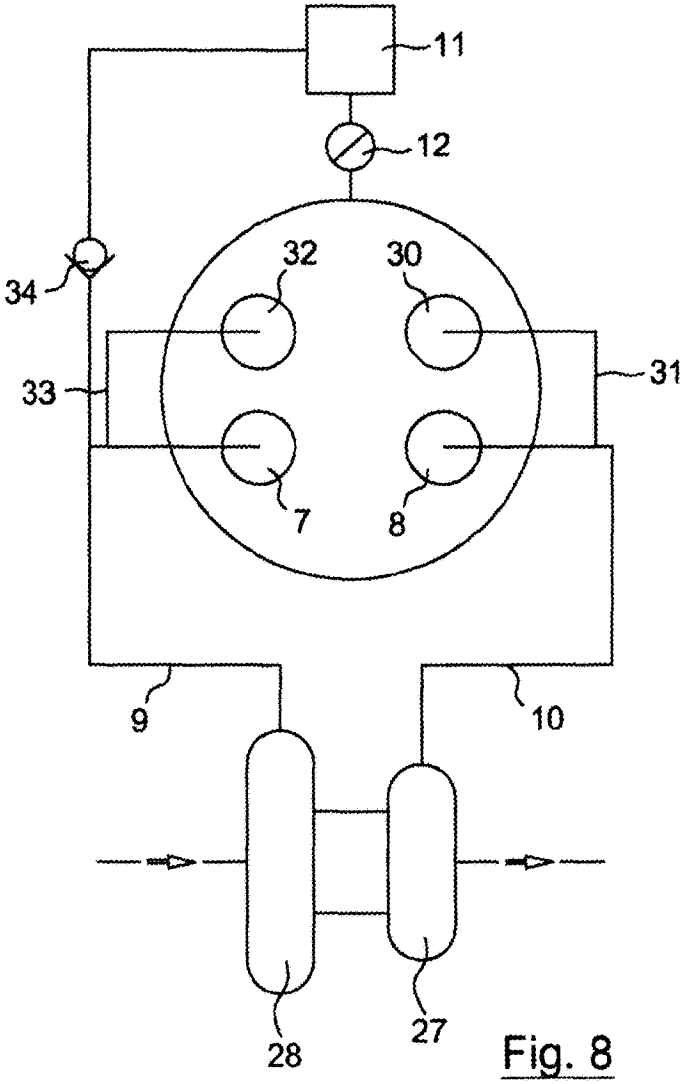
FIG. 8 is a schematic illustration of the combustion engine according to a first alternative of a third embodiment.

Reference is now made to FIGS. 8 and 9, which disclose two alternatives of a third embodiment of the invention. First of all only differences and additions in relation to the above will be described, everything else is the same if nothing else is stated.

According to this third embodiment of the invention the storage reservoir 11 is connected to the intake air channel 9 via a check valve 34, which allow fluid flow from the intake air channel 9 to the storage reservoir 11. According to the first alternative of the third embodiment (FIG. 8) the fluid communication between the storage reservoir 11 and the cylinder volume 6 is controlled by means of the controllable storage reservoir valve 12.

According to the second alternative of the third embodiment (FIG. 9) the fluid communication between the storage reservoir 11 and the cylinder volume 6 is controlled by means of the second inlet valve 32, whereupon the check valve 34 and the storage reservoir 11 are arranged in the second intake air channel 33. The storage reservoir 11 may be constituted by a part of the second intake air channel 33, or alternatively may be constituted by a separate tank arranged in, or connected to, the second intake air channel 33. For sake of clarity it shall be pointed out that the second inlet valve 32 is not controlled jointly with the first inlet valve 7 during engine braking in this second alternative of the third embodiment. During normal operation of the combustion engine, e.g. during propulsion of the vehicle and not during braking, the second inlet valve 32 and the first inlet valve 7 may be controlled jointly.

In this third embodiment of the invention the method comprises the step of ventilating the cylinder volume 6 by means of short opening of the first outlet valve 8, in connection with the piston 3 being located at the upper dead centre and when the fluid communication between the storage reservoir 11 and the cylinder volume 6 is closed, in accordance with the second embodiment described above.

Furthermore the method may comprise the step of keeping the storage reservoir 11 in fluid communication with the cylinder volume 6, in connection with the step of ventilating the cylinder volume 6 by means of short opening of the first outlet valve 8. This results in a great cross-flow of air through the cylinder volume 6 in order to cool down the cylinder 2.

Figure 10:
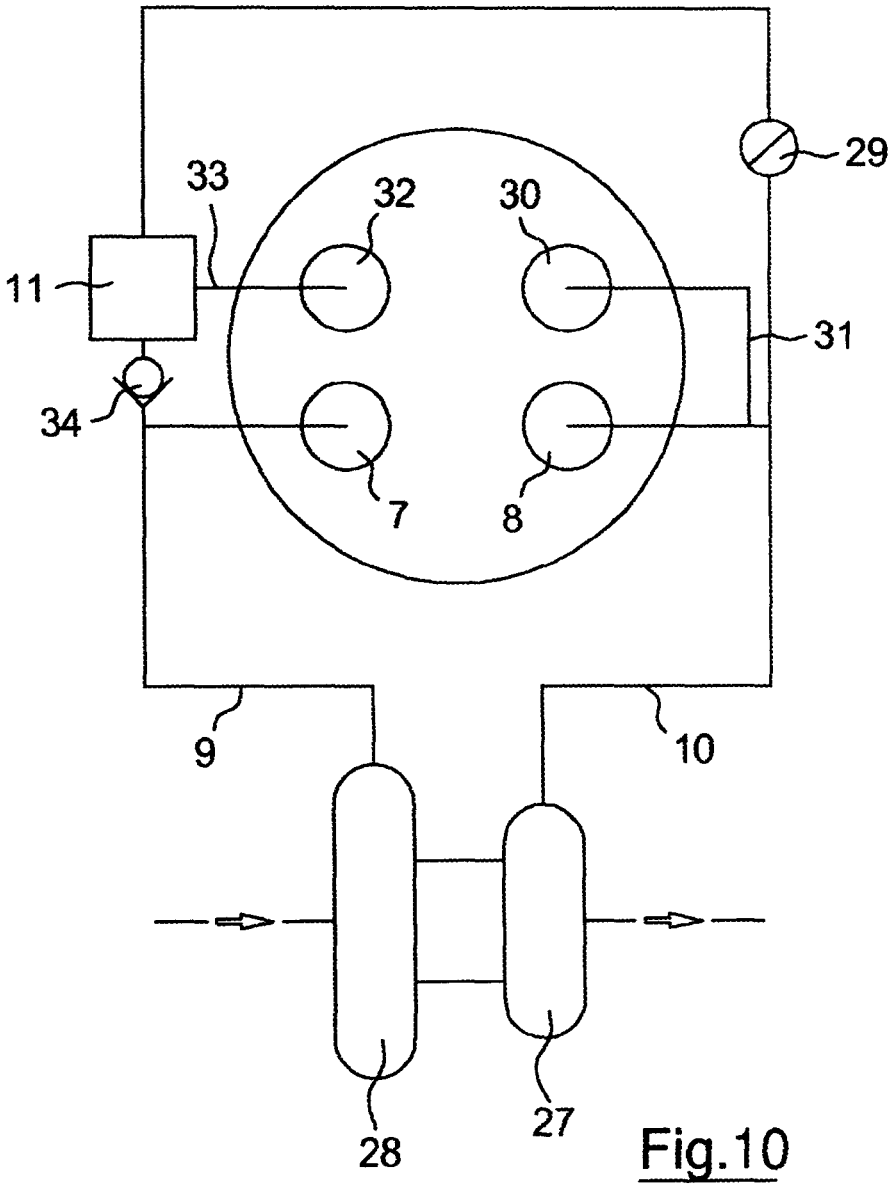
FIG. 10 is a schematic illustration of the combustion engine according to a fourth embodiment.

Reference is now made to FIG. 10 that disclose a fourth embodiment of the invention. First of all only differences and additions in relation to the above will be described, everything else is the same if nothing else is stated. It shall be pointed out that in this embodiment the controllable valve 29 may be constituted by an over pressure valve that opens at a predetermined pressure, however it is mentioned as being the controllable valve 29 for sake of clarity.

The fourth embodiment (FIG. 10) may be described as a combination of the second alternative of the third embodiment (FIG. 9) and the first alternative of the second embodiment (FIG. 6), in which the controllable storage reservoir valve 12 is removed.

According to the fourth embodiment (FIG. 10) the fluid communication between the storage reservoir 11 and the cylinder volume 6 is controlled by means of the second inlet valve 32.

In the embodiments where the storage reservoir 11 is part of the exhaust air channel 10 and where the fluid communication between the storage reservoir 11 and the cylinder volume 6 is controlled by means of the second outlet valve 30, priming of the storage reservoir 11 takes place in the beginning of each engine braking occasion. In the embodiments where the fluid communication between the storage reservoir 11 and the cylinder volume 6 is controlled by means of the storage reservoir valve 12, the storage reservoir 11 preferably remains primed between the engine braking occasions. In the embodiments where the storage reservoir 11 is part of the second exhaust air channel 31 or part of the second intake air channel 33 and where the fluid communication between the storage reservoir 11 and the cylinder volume 6 is controlled by means of the second outlet valve 30 and the second inlet valve 32, respectively, priming of the storage reservoir 11 may take place in the beginning of each engine braking occasion or the storage reservoir 11 may remain primed between the engine braking occasions. During priming the cylinder 2 and the piston 3 are used as a piston compressor.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

The disclosed valve actuators may be exchanged with other actuators without deviating from the present invention.

It shall be pointed out that the term "in connection with . . . " as have been used in the claims as well as in the description, is meant an interval extending from just before to just after the concerned activity.

It shall also be pointed out that in all alternatives/embodiments of the present invention the combustion engine may comprise a first and a second inlet valve and a first and a second outlet valve, respectively, in spite of the fact that it has not been expressly disclosed in the detailed description above.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A method for engine braking in a combustion engine, where the combustion engine has at least one cylinder (2) having a cylinder volume (6) and a piston (3) displaceable in said cylinder (2), an intake air channel (9) having a first pressure (P1), a first inlet valve (7) arranged between the intake air channel (9) and the cylinder volume (6), an exhaust air channel (10) having a second pressure (P2), a first outlet valve (8) arranged between the cylinder volume (6) and the exhaust air channel (10), and a storage reservoir (11) having a third pressure (P3) that is higher than said first pressure (P1) and said second pressure (P2), the storage reservoir (11) being arranged in controllable fluid communication with the cylinder volume (6), the method taking place during a two-stroke cycle and comprises the steps of:

displacing the piston (3) from upper dead centre towards lower dead centre;

keeping the first inlet valve (7) open during at least a part of the time the piston (3) is displaced from the upper dead centre to the lower dead centre;

opening fluid communication between the storage reservoir (11) and the cylinder volume (6), in connection with the piston (3) being located at the lower dead centre and when the first inlet valve (7) is closed;

displacing the piston (3) from the lower dead centre towards the upper dead centre; and keeping the fluid communication between the storage reservoir (11) and the cylinder volume (6) open during at least a part of the time the piston (3) is displaced from the lower dead centre to the upper dead centre.

2. The method according to claim 1, further comprising:

closing the fluid communication between the storage reservoir (11) and the cylinder volume (6), in connection with the piston (3) being located at the upper dead centre.

3. The method according to claim 1, wherein the fluid communication between the storage reservoir (11) and the cylinder volume (6) is kept open during the entire displacement of the piston (3) from the lower dead centre to the upper dead centre.

4. The method according to claim 1, wherein the fluid communication between the storage reservoir (11) and the cylinder volume (6) is opened and closed a plurality of times during the displacement of the piston (3) from the lower dead centre to the upper dead centre.

5. The method according to claim 1, wherein the combustion engine comprises a turbine (27) arranged downstream of the exhaust air channel (10), and an air compressor (28) arranged upstream of the intake air channel (9), the turbine (27) being configured to drive the air compressor (28), wherein the combustion engine includes a controllable valve (29) arranged in the exhaust air channel (10), the storage reservoir (11) being arranged between the first outlet valve (8) and the controllable valve (29), and wherein the method further comprises the step of:

ventilating the cylinder volume (6) by means of a short opening of the first inlet valve (7), in connection with the piston (3) being located at the upper dead centre and when the fluid communication between the storage reservoir (11) and the cylinder volume (6) is closed.

6. The method according to claim 1, wherein the combustion engine comprises a turbine (27) arranged downstream the exhaust air channel (10), and an air compressor (28) arranged upstream the intake air channel (9), the turbine (27) being configured to drive the air compressor (28), wherein the storage reservoir (11) is connected to the exhaust air channel (10) via a controllable valve (29), and wherein the method further comprises the step of:

ventilating the cylinder volume (6) by means of a short opening of the first outlet valve (7), in connection with the piston (3) being located at the upper dead centre and when the fluid communication between the storage reservoir (11) and the cylinder volume (6) is closed.

7. The method according to claim 6, wherein the method, in connection with the step of keeping the first inlet valve (7) open during at least a part of the time the piston (3) is displaced from the upper dead centre to the lower dead centre, further comprises the step of:

keeping the controllable valve (29) open in order to have the storage reservoir (11) in fluid communication with the turbine (27).

8. The method according to claim 1, wherein the combustion engine comprises a turbine (27) arranged downstream the exhaust air channel (10), and an air compressor (28) arranged upstream the intake air channel (9), the turbine (27) being configured to drive the air compressor (28), wherein the storage reservoir (11) is connected to the exhaust air channel (10) via a controllable valve (29), and wherein the method, in connection with the step of keeping the first inlet valve (7) open during at least a part of the time the piston (3) is displaced from the upper dead centre to the lower dead centre, further comprises the step of:

keeping the controllable valve (29) open in order to have the storage reservoir (11) in fluid communication with the turbine (27).

9. The method according to claim 5, wherein the storage reservoir (11) is connected to the intake air channel (9) via a check valve (34), allowing fluid flow from the intake air channel (9) to the storage reservoir (11), and wherein the method further comprises the step of:

ventilating the cylinder volume (6) by means of a short opening of the first outlet valve (8), in connection with the piston (3) being located at the upper dead centre and when the fluid communication between the storage reservoir and the cylinder volume (6) is closed.

10. A combustion engine, comprising:

at least one cylinder (2) having a cylinder volume (6) and a piston (3) displaceable in said cylinder (2);

an intake air channel (9) having a first pressure (P1);

a first inlet valve (7) arranged between the intake air channel (9) and the cylinder volume (6);

an exhaust air channel (10) having a second pressure (P2);

a first outlet valve (8) arranged between the cylinder volume (6) and the exhaust air channel (10); and a storage reservoir (11) having a third pressure (P3) that is higher than said first pressure (P1) and said second pressure (P2), the storage reservoir (11) being arranged in controllable fluid communication with the cylinder volume (6), the combustion engine (1) being configured to be driven in two-stroke cycle during engine braking, the first inlet valve (7) being configured to be open during at least a part of the time the piston (3) is displaced from the upper dead centre to the lower dead centre, the combustion engine being configured to open the fluid communication between the storage reservoir (11) and the cylinder volume (6) in connection with the piston (3) being located at the lower dead centre and when the first inlet valve (7) is closed, and the storage reservoir (11) being configured to be in fluid communication with the cylinder volume (6) during at least a part of the time the piston (3) is displaced from the lower dead centre to the upper dead centre.

11. The combustion engine according to claim 10, further comprising:

a turbine (27) arranged downstream the exhaust air channel (10); and an air compressor (28) arranged upstream the intake air channel (9), the turbine (27) being configured to drive the air compressor (28).

12. The combustion engine according to claim 11, further comprising:

a controllable valve (29) arranged in the exhaust air channel (10), the storage reservoir (11) being arranged between the first outlet valve (8) and the controllable valve (29).

13. The combustion engine according to claim 11, wherein the storage reservoir (11) is connected to the exhaust air channel (10) via a controllable valve (29).

14. The combustion engine according to claim 11, wherein the storage reservoir (11) is connected to the intake air channel (9) via a check valve (34), allowing fluid flow from the intake air channel (9) to the storage reservoir (11).

15. The method according to claim 2, wherein the fluid communication between the storage reservoir (11) and the cylinder volume (6) is kept open during the entire displacement of the piston (3) from the lower dead centre to the upper dead centre.

16. The method according to claim 2, wherein the fluid communication between the storage reservoir (11) and the cylinder volume (6) is opened and closed a plurality of times during the displacement of the piston (3) from the lower dead centre to the upper dead centre.

17. The method according to claim 2, wherein the combustion engine comprises a turbine (27) arranged downstream of the exhaust air channel (10), and an air compressor (28) arranged upstream of the intake air channel (9), the turbine (27) being configured to drive the air compressor (28), wherein the combustion engine includes a controllable valve (29) arranged in the exhaust air channel (10), the storage reservoir (11) being arranged between the first outlet valve (8) and the controllable valve (29), and wherein the method further comprises the step of:

ventilating the cylinder volume (6) by means of a short opening of the first inlet valve (7), in connection with the piston (3) being located at the upper dead centre and when the fluid communication between the storage reservoir (11) and the cylinder volume (6) is closed.

18. The method according to claim 3, wherein the combustion engine comprises a turbine (27) arranged downstream of the exhaust air channel (10), and an air compressor (28) arranged upstream of the intake air channel (9), the turbine (27) being configured to drive the air compressor (28), wherein the combustion engine includes a controllable valve (29) arranged in the exhaust air channel (10), the storage reservoir (11) being arranged between the first outlet valve (8) and the controllable valve (29), and wherein the method further comprises the step of:

ventilating the cylinder volume (6) by means of a short opening of the first inlet valve (7), in connection with the piston (3) being located at the upper dead centre and when the fluid communication between the storage reservoir (11) and the cylinder volume (6) is closed.

19. The method according to claim 4, wherein the combustion engine comprises a turbine (27) arranged downstream of the exhaust air channel (10), and an air compressor (28) arranged upstream of the intake air channel (9), the turbine (27) being configured to drive the air compressor (28), wherein the combustion engine includes a controllable valve (29) arranged in the exhaust air channel (10), the storage reservoir (11) being arranged between the first outlet valve (8) and the controllable valve (29), and wherein the method further comprises the step of:

ventilating the cylinder volume (6) by means of a short opening of the first inlet valve (7), in connection with the piston (3) being located at the upper dead centre and when the fluid communication between the storage reservoir (11) and the cylinder volume (6) is closed.

20. The method according to claim 2, wherein the combustion engine comprises a turbine (27) arranged downstream the exhaust air channel (10), and an air compressor (28) arranged upstream the intake air channel (9), the turbine (27) being configured to drive the air compressor (28), wherein the storage reservoir (11) is connected to the exhaust air channel (10) via a controllable valve (29), and wherein the method further comprises the step of:

ventilating the cylinder volume (6) by means of a short opening of the first outlet valve (7), in connection with the piston (3) being located at the upper dead centre and when the fluid communication between the storage reservoir (11) and the cylinder volume (6) is closed.

* * * * *